US006607198B2

(12) United States Patent
Szendel

(10) Patent No.: US 6,607,198 B2
(45) Date of Patent: Aug. 19, 2003

(54) IN-LINE ROLLER SKATES HAVING QUICK-RELEASE AXLE SYSTEM WITH SAFETY RETAINING PIN MECHANISM

(75) Inventor: Adrian James Szendel, Brunswick, OH (US)

(73) Assignee: Age of Blades, Inc., Maple Heights, OH (US)

( * ) Notice: Subject to any disclaimer, the term of this patent is extended or adjusted under 35 U.S.C. 154(b) by 0 days.

(21) Appl. No.: 09/935,295

(22) Filed: Aug. 22, 2001

(65) Prior Publication Data

US 2002/0070512 A1 Jun. 13, 2002

Related U.S. Application Data

(63) Continuation of application No. 08/918,808, filed on Aug. 26, 1997, now abandoned.

(51) Int. Cl.[7] ..... A63C 1/00
(52) U.S. Cl. ..... 280/11.27; 280/11.223
(58) Field of Search ..... 280/11.19, 11.221, 280/11.223, 11.27, 7.13

(56) References Cited

U.S. PATENT DOCUMENTS 2,733,065 A * 1/1956 Barkschat ..... 280/11.27
4,603,868 A * 8/1986 Schutz ..... 280/11.223
5,271,633 A * 12/1993 Hill, Jr. ..... 280/11.221
5,441,286 A * 8/1995 Pozzobon ..... 280/11.223
5,470,086 A * 11/1995 Peterson et al. ..... 280/11.223
5,511,824 A * 4/1996 Kim ..... 280/11.19
5,527,050 A * 6/1996 Szendel ..... 280/11.223
5,533,740 A * 7/1996 Lin ..... 280/11.223
5,716,060 A * 2/1998 Szendel ..... 280/11.223
5,769,432 A * 6/1998 Tybinkowski et al. . 280/11.204
5,800,022 A * 9/1998 Del Rosario ..... 280/11.221
5,873,584 A * 2/1999 Wrike ..... 280/11.221
5,882,087 A * 3/1999 Post ..... 301/110.6
5,884,923 A * 3/1999 Pratt ..... 280/11.221
5,941,539 A * 8/1999 Pratt ..... 280/11.223
5,988,656 A * 11/1999 Krah ..... 280/11.19

* cited by examiner

*Primary Examiner*—Brian L. Johnson
*Assistant Examiner*—Bridget Avery
(74) *Attorney, Agent, or Firm*—Thomas J. Perkowski Esq., P.C.

(57) ABSTRACT

A quick-release type axle system for in-line skates. A pair of axle shafts cooperate with each other to support a wheel between a pair of frames. A release pin is inserted into a central bore formed through the axle shafts to lock the axle shafts relative to each other. In one embodiment, the release pin is pulled outwardly to release the axle shafts from the locked configuration, whereas in another embodiment, the release pin is pushed inwardly to achieve unlocking of the axle shafts. In some embodiments, a pair of release pins are used to achieve the quick-release mechanism of the present invention.

7 Claims, 11 Drawing Sheets

IN-LINE ROLLER SKATES HAVING QUICK-RELEASE AXLE SYSTEM WITH SAFETY RETAINING PIN MECHANISM

CROSS-REFERENCE TO RELATED U.S. APPLICATIONS

This is a Continuation of Application Ser. No. 08/918,808, filed Aug. 26, 1997, now abandoned, said application being owned by Assignee, Age of Blades, Inc. of Maple Heights, Ohio, and incorporation herein by reference as if fully set forth herein.

BACKGROUND OF INVENTION

1. Field of Invention

The present invention relates generally to in-line roller skates, and more particularly to a quick-release axle system for use in the same.

2. Brief Description of Prior Art

There are currently a wide variety of prior art axle systems in use for mounting the wheels on in-line roller skates. Each skate manufacturing company has it's own unique design and there are several after-market companies which also manufacture axle kits. Although each one differs somewhat in design, the general configuration invariably involves a threaded portion which is fastened with a nut.

In the common nut and bolt type axle system, the bolt (acting as the axle shaft) passes through the axle aperture in the skate frame, then through the bearings and bearing spacer, and is held in place with a nut which is threaded onto the bolt from the opposite side and tightened against the skate frame.

Other systems have the threaded portion on the inside of the axle shaft. A screw is threaded into the axle from the opposite side and tightened to hold it in place. A third popular method involves threading the inside of the bearing spacer itself. A screw is then inserted from each side of the frame and threaded into the bearing spacer forming an axle to support the wheel.

All of these method involve a tightening sequence using allen wrenches, screw drivers, or wrenches of some type making installation or removal of the wheels a tedious and time-consuming process.

In addition, it is a common problem to have the keyed slot, whether it be for an allen key or screwdriver, strip out making it extremely difficult, if not impossible, to remove the axle with the standard designated tools. Usually these can only be removed by drilling or cutting the axle and replacing it with a new one.

It is also possible for crossthreading to occur during assembly which makes removal extremely difficult as well.

Thus, there is a great need in the art for an improved axle system for use in connection with in-line roller skates, while avoiding the shortcomings and drawbacks of prior art axle systems and wheel mounting methodologies.

OBJECTS AND SUMMARY OF THE PRESENT INVENTION

Accordingly, it is a primary object of the present invention to provide an improved axle system for use in connection with in-line roller skates, while avoiding the shortcomings and drawbacks of prior art axle systems and wheel mounting methodologies.

A further object of the present invention is to provide such an axle system, in which a quick release, snap-lock apparatus is used to secure the wheels to the frame on an in-line skate.

A further object of the present invention is to provide such an axle system, which can accommodate the different axle aperture diameters and bearing spacers most common a quick release, snap-lock apparatus is used to secure the wheels to the frame on an in-line skate.

A further object of the present invention is to provide such an axle system, which can accommodate the different axle aperture diameters and bearing spacers most commonly used in in-line roller skates.

A further object of the present invention is to provide a quick-release type axle system, in which a pair of axle shafts automatically engage and lock with a bearing spacer within a skate wheel when a pair of axle release pins are inserted into a central bore formed through each such axle shafts, and the axle shafts automatically disengage form the bearing spacer when the release pins are pulled out slightly from the axle shafts.

A further object of the present invention is to provide a quick-release type axle system, in which a pair of axle shafts automatically engage and lock with each other when an axle release pin is inserted into a central bore formed through one of such axle shaft and the axle shafts automatically disengage with each other when the release pin are pulled out lightly from the axle shaft.

A further object of the present invention is to provide a quick-release type axle system, in which a pair of axle shafts automatically engage and lock with a bearing spacer within a skate wheel when a pair of axle release pins are inserted into a central bore formed through each such axle shaft, and the axle shafts automatically disengage from the bearing spacer when the release pins are pushed inwardly into the bore formed in the axle shaft.

A further object of the present invention is to provide a quick-release type axle system, in which a pair of axle shafts automatically engage and lock with each other when the axle release pin is inserted into a central bore formed through one of such axle shafts and the axle shafts automatically disengage with each other when the release pin is pushed inwardly into the bore formed in the axle shaft.

BRIEF DESCRIPTION OF THE DRAWINGS

For a more complete understanding of the Objects of the Present Invention, the following Detailed Description of the Illustrative Embodiments of the Present Invention should be read in conjunction with the accompanying Drawings, wherein.

DETAILED DESCRIPTION OF THE ILLUSTRATIVE EMBODIMENTS OF THE PRESENT INVENTION

Figure 1:
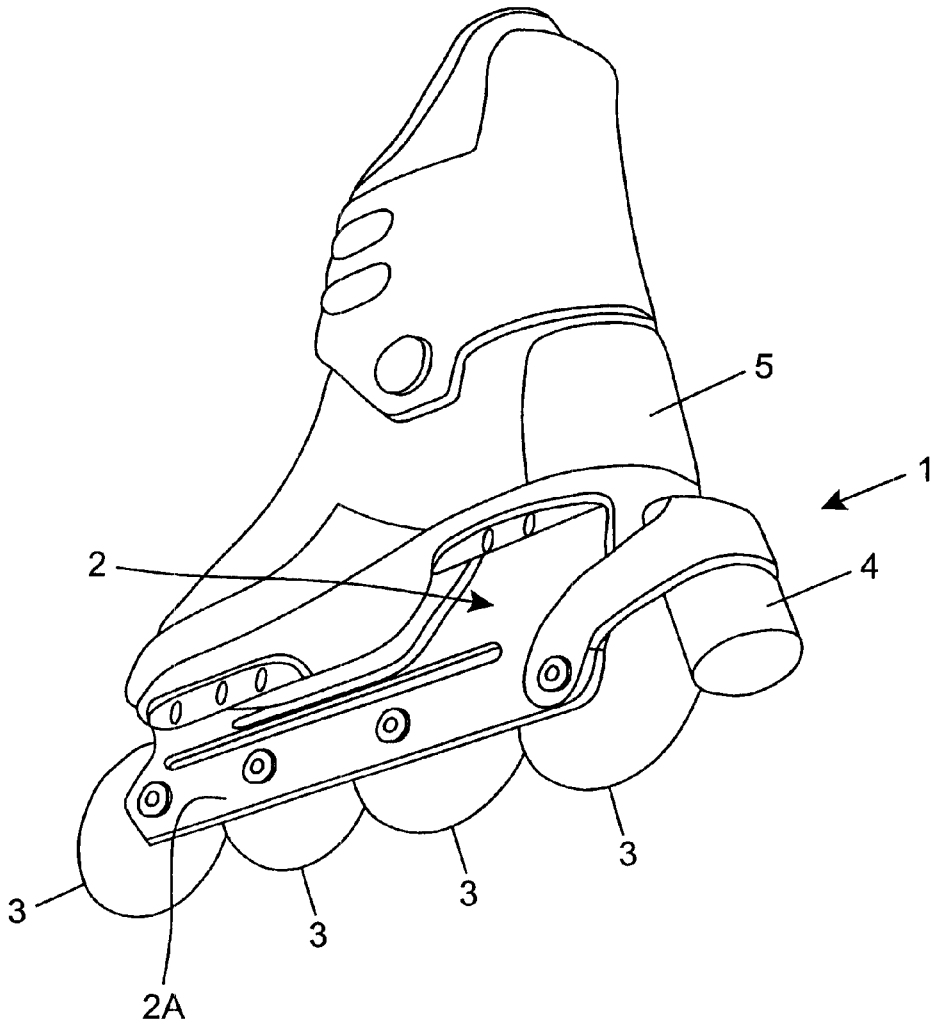
FIG. 1 is a perspective view of an in-line roller skate, incorporating the quick-release axle system of the first illustrative embodiment of the present invention.

Referring to the figures in the Drawings, the illustrative embodiments of the in-line roller skate of the present invention, and the quick-release axle systems incorporated therein, will be described in great detail. In connection with this detailed description, like structures being indexed with like reference numbers.

Overview of the In-Line Skate of the Present Invention

As shown in FIG. 1, a generalized embodiment of an in-line skate of the present invention, comprises a number of components, namely: a frame 1 having a pair of spaced apart frame rails 2A and 2B; a set of wheels 3, rotatably supported by way of the quick-release axle system of the present invention, between the frame rails; a brake structure 4 typically made of rubber or hard plastic and mounted on the rear of the skate frame, for use in braking operations; and a boot portion 5 mounted to the frame and adapted for comfortable receiving the foot of its user. Details regarding the general design of prior art in-line skates are disclosed in Applicant's U.S. Pat. No. 5,362,075, incorporated herein by reference. It is understood that the design of the boot and the frame structure of the in-line skate hereof may differ from embodiment to embodiment thereof without departing from the scope or spirit of the present invention. Any of the illustrative embodiments of the quick-release axle system of the present invention described below can be incorporated in such in-line skate designs.

Figure 2:
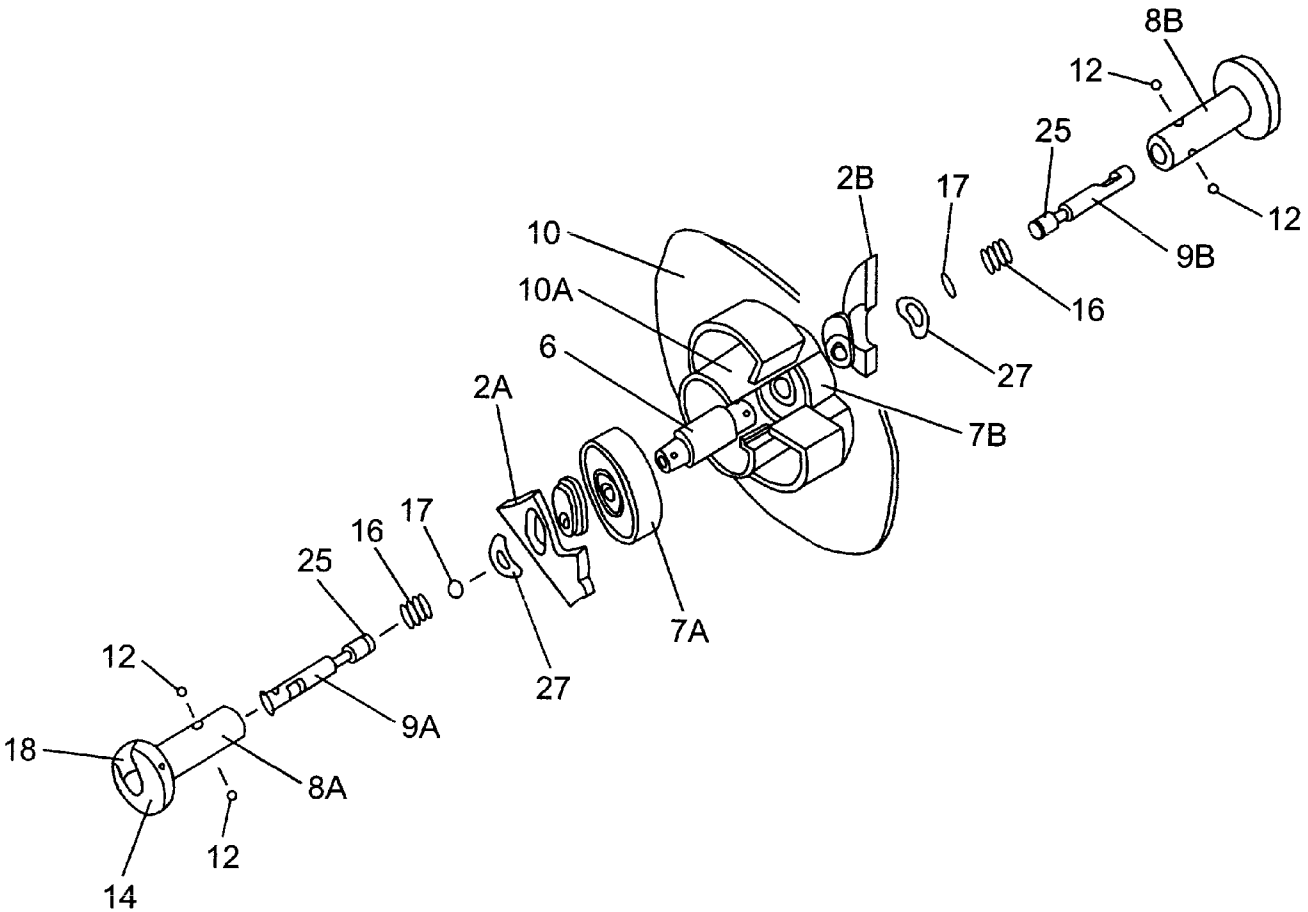
FIG. 2 is an exploded diagram of the quick-release axle system of first illustrative embodiment of the present invention, showing the major subcomponents thereof.
Figure 2A:
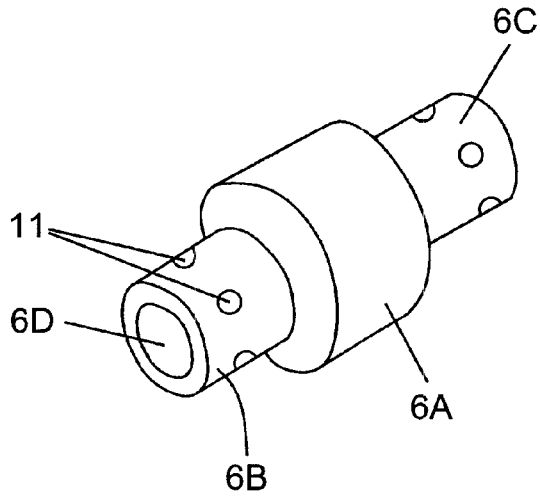
FIG. 2A is a perspective view of the another type of bearing spacer used in conjunction with the quick-release axle system of the first embodiment.
Figure 2B:
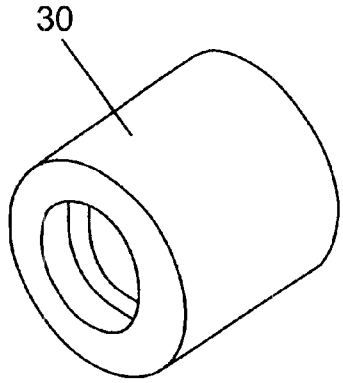
FIG. 2B is a perspective view of the bearing spacer used in conjunction with the quick-release axle system of the second embodiment.

In-Line Skate Embodying the Quick-Release Axle System of the First Illustrative Embodiment of the Present Invention In FIG. 2, an exploded perspective view of the quick-release axle system of the first illustrative embodiment is shown. As illustrated, the system comprises three subcomponents, namely: a bearing spacer 6 installed between the bearing assemblies 7A and 7B; first and second axle shafts 8A and 8B; and first and second axle-shaft release pins 9A and 9B. Notably, as axle shafts 8A and 8B are identical, the description of the structure will be made with reference to axle shaft 8B for purposes of explication. Each wheel on the in-line skate consists of a tire portion 10 surrounding an inner core 10A which has been formed with an inner bore so as to receive bearings 7A and 7B with bearing spacer 6 disposed therebetween.

Figure 3:
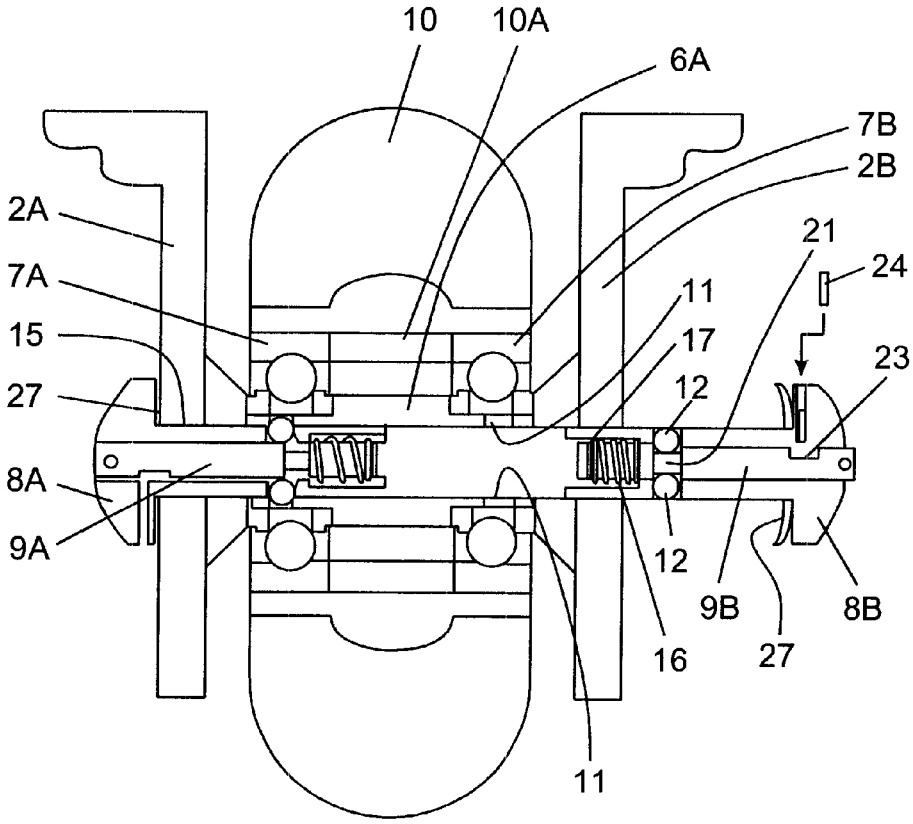
FIG. 3 is a cross-sectional diagram of the quick-release axle system of the present invention showing both axle shafts of the system. The axle shaft on the left is in its locked and ready position, while the axle shaft on the right is in the release position as it would appear being either withdrawn or inserted through the axle aperture.
Figure 4:
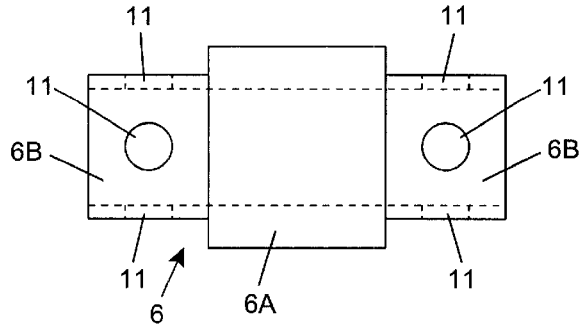
FIG. 4 is an elevated side view of the bearing spacer used in the first illustrative embodiment of the axle system of the present invention.
Figure 4A:
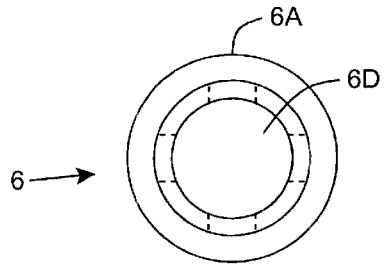
FIG. 4A is a cross-sectional view of the bearing spacer of the illustrative embodiment, taken along line 4A—4A of FIG. 4.

As shown in FIGS. 3 and 4, the bearing spacer 6 has a central portion 6A and hollow end portions 6B and 6C extending therefrom. The ends of the bearing spacer 6 are machined with an outer diameter that permits the bearing spacer to fit into the inner bore of the inner race of the bearings 7A and 7B. The center portion of the spacer 6A has a larger diameter than the end portions thereof 6B and 6C in order to create a shoulder that contacts the inner races of the bearings. The bearing spacers are provided with an inner bore 6D through which each wheel axle shaft 8A and 8B is passed enabling the wheel to be attached to the skate frame. In the illustrative embodiment, four equally-spaced indents 11 (e.g., holes of 0.0940 inch diameter) are formed at a predetermined distance from the end of the bearing spacer. The function of these holes is to receive an axle-locking ball (i.e., spherical element) 12 (e.g., 0.09385 inch diameter). This arrangement forms a mechanism for locking the axle shaft relative to the bearing spacer. The steel material of the axle shaft around these ball bearings is crimped in order to keep them from falling back out of the detents.

Figure 5:
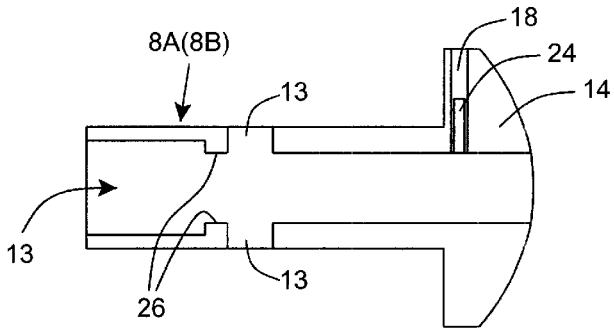
FIG. 5 is an elevated cross-sectional diagram of one of the axle shafts removed from the quick-release axle system of the first illustrative embodiment.
Figure 6:
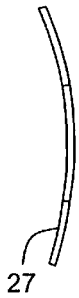
FIG. 6 is an elevated side view of the spring-like lock washer used in conjunction each axle shaft of the quick-release axle system of the first illustrative embodiment.

As shown in FIGS. 3 and 5, each axle shaft 8A and 8B has a hollow bore 13 (of about 0.130 inch diameter) formed centrally therethrough, and an end cap portion 14. In the illustrative embodiment, the cap portion is about 0.1875 inches at its thickest point. A recess, FIG. 2, 18 is machined into one half of the cap portion 14 in order to allow for an access point for the release pin. The outer diameter of the axle shaft has an outer diameter of about a 0.25 inch and is adapted for insertion through an aperture 15 formed in the frame rail and the hollow bore 6D of the end portion of the bearing spacer. The bore at one end of the axle shaft is enlarged to a diameter of 0.1875 for a length of about 0.215 inches in order to accommodate a return spring 16 and retaining clip 17 slipped over the end of the release pin 9A (9B).

Figure 7:
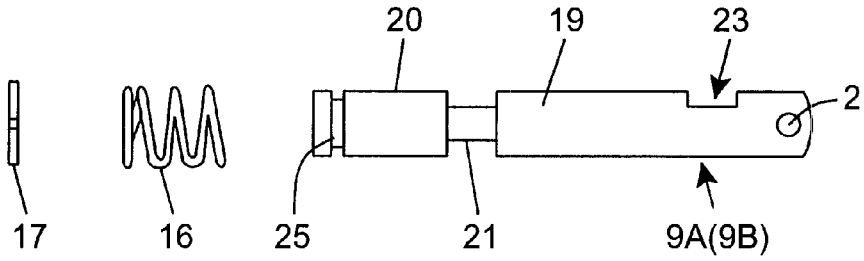
FIG. 7 is an elevated side view of the release pin, spring and C-clip subassembly that slides along the central bore of each axle shaft of the quick-release axle system of the first illustrative embodiment.

As shown in FIG. 7, each axle-shaft release pin 9A and 9B has a first cylindrical body portion 19 of a first length, and a second cylindrical body portion 20 of a second (i.e., shorter) length separated by a tapered portion 21 of narrower diameter than the first and second cylindrical portions of the release pin. A hole 22 having a 0.0625 inch diameter is drilled through the release pin shaft 19 at about 0.093 inches from one end of the shaft, as shown in FIG. 3. The function of hole 22 is to allow a tool or pin to be used to poll the release pin 9A, (9B) out of the axle shaft during axle release operations. When the release pin is retained within the axle shaft, during the axle locked configuration, the hole 22 in the release pin is recessed within the end of the axle shaft (as shown in the left side of FIG. 3) and thus, cannot be inadvertently pulled out during roller skating activity.

In the illustrative embodiment, a recess or slot 23 (e.g., having dimensions of 0.0312 inch deep×0.145 inches long) is machined into the shaft at about 0.100 inches from the end of the release pin 9A where the hole 22 has been drilled. The function of this slot 23 is to allow for the insertion of a retaining pin or screw 24 through a hole drilled laterally through the side of the cap portion extending therefrom into the inner bore of the axle shaft so that the release pin can be retained within the bore of the axle shaft.

As shown in FIGS. 3 and 7, a small return spring 16 is installed over the end of the release pin shaft 20 and c-clip retainer 17 is pushed onto a machined groove 25 in the axle shaft in order to retain the return spring on the end portion thereof. The function of the return spring 16 is to hold the release pin in the locked position within the axle shaft during the vibration encountered while skating. With this arrangement, the return spring 16 is then trapped between the c-clip 17 and the inner flange 26 machined within the bore of the axle shaft, while the retaining screw 24 is inserted into the slot 23 formed in the end of the release pin. As shown in FIG. 3, the release pin 22 is retained within the bore of the perspective axle shaft and is permitted to slide therewithin a distance equal to the length of slot 23 formed in the end of the release pin.

As shown in FIG. 3, a curved spring steel washer 27 (of 0.017 inches thickness and 0.500 inch outer diameter and inner diameter of about 0.251 inches) is positioned over the axle shaft. The spring washer 27 is pressed against the inner surface of the end cap 14 in order to provide tightness when the axle shafts are installed and locked to the bearing spacer. Also, a nylon plastic cover may be fashioned to snap-fit over the cap end 14 of the main axle.

Assembly and Disassembly of the Quick Release Axle System of the First Illustrative Embodiment of the Present Invention Each bearing 7A and 7B is installed into the wheel from opposite sides, separated by bearing spacer 6A. As the axle shaft is inserted into the bore of the bearing spacer, the locking balls 12 held within the shaft by crimpings automatically fall into place into the corresponding holes 11 in the bearing spacer. The release pin is then allowed to retract within the inner bore of the axle shaft due to the pressure of the return 16 which automatically forces the release pin inward toward the bearing spacer so that the central portion 21 thereof is positioned directly beneath detent holes 11 and contacts the surface of the steel locking balls 12 forcing them to remain locked within the holes 11 (detents) formed in the bearing spacer. In this locked configuration, shown in the left side of FIG. 3, the cylindrical portion 19 of the release pins 9A renders it impossible for the ball bearings 12 to move downward, or out of their corresponding detents, and thus provides an extremely strong and efficient locking mechanism.

When the release pin 9A is pulled outwardly from the axle shaft 6A by an amount limited by the length of slot 23, (i.e. against the outwardly directed biasing forces produced by return spring 16), the ball bearings 12 are permitted to fall within the narrow circumferential groove 21 formed in the portions of the release pin, as shown in the right side of the figure of FIG. 3. In this unlocked configuration the axle shaft is released from the bearing spacer and can be withdrawn from the bearing spacer, wheel assembly and skate frame. When both release pins on a particular wheel have been "released" or arranged into their unlocked configuration, then the associated axle shafts can be withdrawn from the bearing spacer and the wheel assembly easily removed from the frame of the in-line skate.

Pulling the spring-biased release pin 9A out from its corresponding axle shaft can be carried out using a small tool. (e.g. a paper clip or an accessory device). The tool is slid through the hole 22 formed in the end of the release pin and allows the release pin to be pulled out slightly (against the force of the return spring) so that the balls 12 retaining the axle shaft within the bearings spacer can be allowed to fall out of their corresponding holes, as described hereinabove.

In the locked configuration, curved spring steel washer 27 applies pressure to the outside of the skate frame in order to take up any slack and provide a tight fit. The fit can be adjusted further, if desired, by using washers of different thicknesses as shims installed over the axle shaft to be positioned between the spring steel washer and the skate frame.

Figure 8:
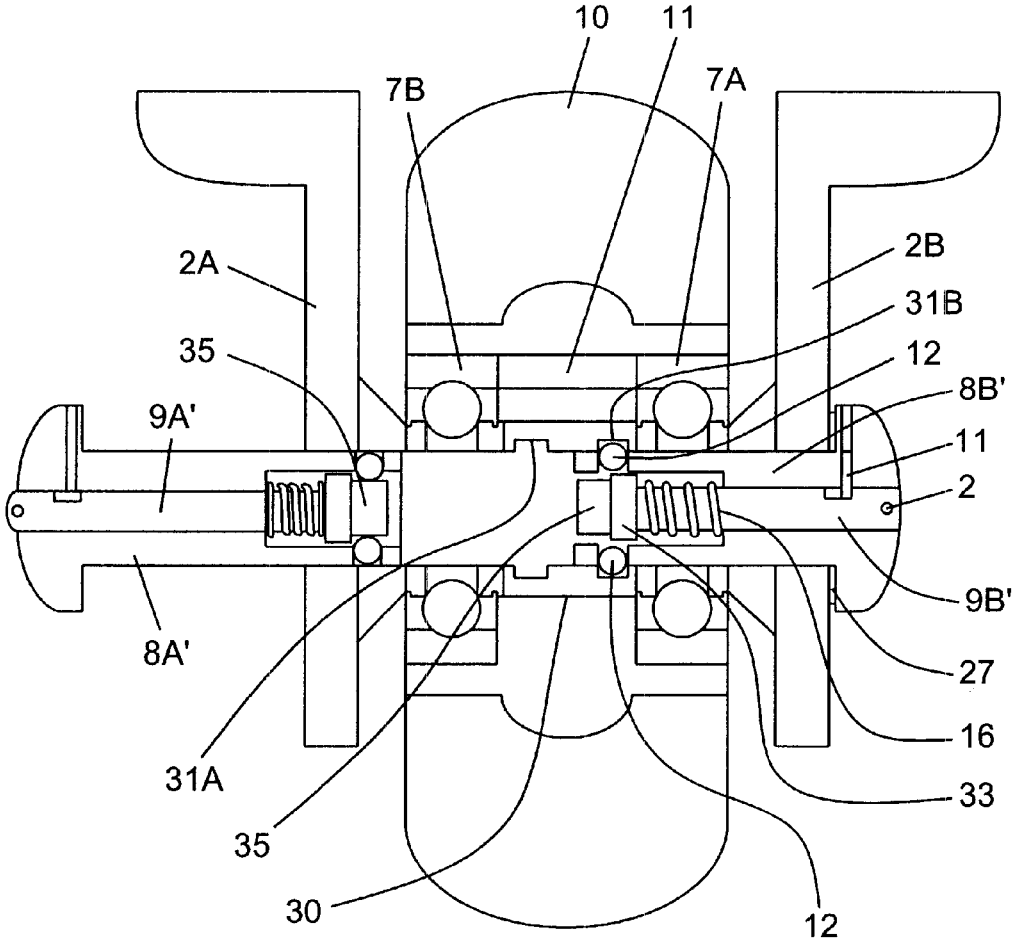
FIG. 8 is an elevated, cross-sectional schematic diagram of the second illustrative embodiment of the quick-release axle system of the present invention, showing a pair of axle portions releasably engaged with a bearing spacer supported within a wheel of an in-line skate.
Figure 8A:
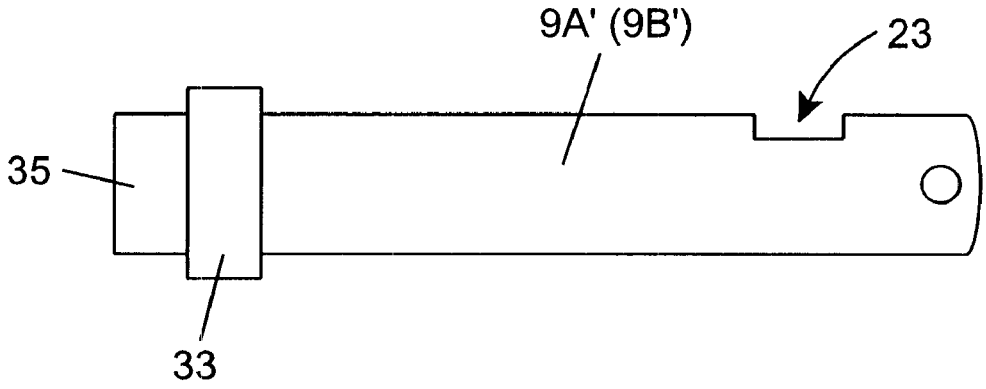
FIG. 8A is an elevated side view of the release pin as used in conjunction with the quick-release axle system of the second embodiment of FIG. 8 which utilized the "pull" method for axle release.

In-Line Skate Embodying the Quick-Release Axle System of the Second Illustrative Embodiment of the Present Invention A second illustrative embodiment of the quick-release axle system of the present invention is shown in FIGS. 8 and 8A. While this embodiment is quite similar to the embodiment of FIG. 3, there are a number of minor differences. In particular, the bearing spacer 30 in FIG. 8 does not have an outer bore surface that slides into the inner bore of the inner race of the bearing, as in the first embodiment shown in FIG. 3. Instead, the bearing spacer 30 is shaped like a bushing whose inner and outer diameters are exactly the same as the inner and outer diameters of the inner race of the bearing itself. Therefore, the axle shaft diameter is larger in order to correspond with the diameter of the inner bore of the inner bearing race.

Circumferential grooves 31A and 31B are cut into the inner surface of the inner bore of the bearing spacer 30 (about 0.030 inches deep) in lieu of the equally spaced holes in the bearing spacer of the first illustrative embodiment described above. When the axle shaft is pushed into place, the locking balls lock into place within the recess provided by the groove. The groove is positioned so as to create a tight fit between the flange and the skate frame upon installation. Other minor differences will be described below.

Assembly and Disassembly of the Quick-Release Axle System of the Second Illustrative Embodiment of the Present Invention As in the case of the first illustrative embodiment, each bearing is installed into the wheel from opposite sides and seperated by bearing spacer 30. As the axle shafts 6A and 6B are inserted into the bore of the bearing spacer, the locking balls 12 held within the shaft by crimpings automatically fall into place into corresponding grooves 31A and 31B. Releasing the release pin allows pressure from the return spring 116, which is compressed within the bore of shaft 6A (6B) between interior flange 34 and circumferential flange 33, to cause the release pin to slide inward toward the center of the spacer, so that the outer surface of circumferential flange 33 is disposed directly beneath and contacts the surface of the axle-locking balls 12, forcing them to remain locked within the circumferential groove 31A (31B) formed in the inner bore of the bearing spacer. In this configuration, the end of the release pin will remain recessed within the bore of the axle shaft, while the axle shaft and bearing spacer are securely locked together and the release pin is prevented from being inadvertently pulled out of its locked configuration. In this locked configuration, shown in the right side of the figure of FIG. 8, the release pin 9A (9B) renders it impossible for the ball bearings 12 to move downward, or out of their corresponding grooves 31A (31B), and thus provides an extremely strong and efficient locking mechanism.

When the release pin 9A (9B) is pulled outwardly by an amount limited by the length of slot 23, (i.e., against the outwardly directed biasing forces produced by return spring), the locking balls 12 are permitted to fall within the narrow circumferential recess 35 formed between the outer surface of the ends portions of the release pin, as shown in the left side of the figure of FIG. 8. In this unlocked configuration, the axle shaft is released from the bearing spacer and can be withdrawn from the bearing spacer 30, wheel assembly and skate frame. When both release pins on a particular wheel have been "released" or arranged into their unlocked configuration, then the associated axle shafts can be withdrawn from the bearing spacer 30 and the wheel assembly can be easily removed from the frame of the in-line skate.

Pulling the spring-biased release pin 9A (9B) out from its corresponding axle shaft can be carried out using a small tool, (e.g., a paper clip or accessory device) that slides through the hole 22 formed in the end of the release pin and allows the release pin to be pulled out lightly (against the force of the return spring) so that the locking balls 12 retaining the axle shaft within the bearing spacer 30 can be allowed to fall out of their corresponding holes, as described hereinabove.

Figure 9:
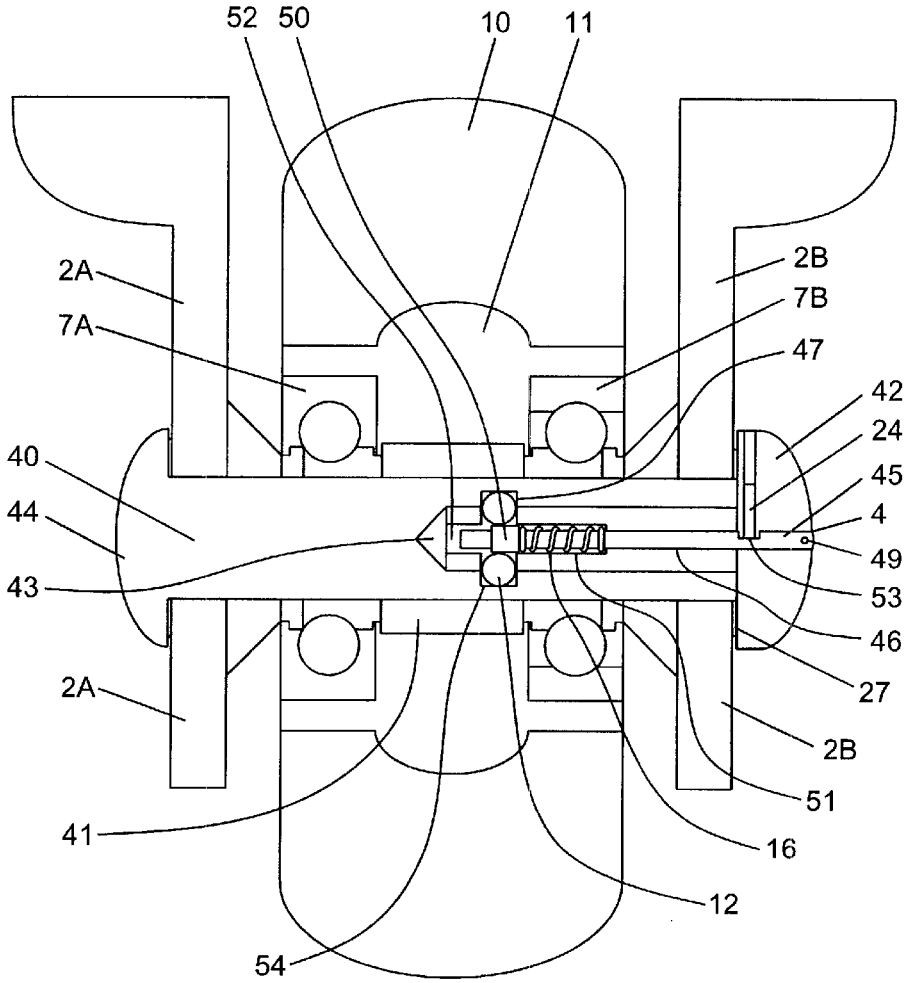
FIG. 9 is an elevated, cross-sectional schematic diagram of the third illustrative embodiment of the quick-release axle system of the present invention, showing a pair of axle potions releasable engaged with each other while passing through a wheel of an in-line skate.

In-Line Skate Embodying the Quick-Release Axle System of the Third Illustrative Embodiment of the Present Invention In FIG. 9, a third alternative embodiment of the present invention is shown. In this embodiment, the bearing spacer is not used as part of the axle-shaft locking mechanism. Instead, the axle system comprises: a main axle shaft 40 insertable through the first skate frame wall 2A, the first bearing 7A, the bearing spacer 41, the second bearing 7B, and the second skate frame wall; and a secondary axle shaft 42 for insertion within a central bore 43 formed within the main axle shaft 40. As shown in FIG. 8, the main shaft axle has head portion 44 formed on one end of its cylindrical body portion, and central bore 43 formed through the end of its body portion opposite head portion 44. The length of the bore 43 extends about half way across the length of the axle shaft. A release pin 45, similar in design as the release pin 9A (9B) shown in FIG. 8, is provided for insertion through a central bore 46 formed in the secondary axle shaft 42, to engage with ball bearing 12. As shown in FIG. 9, a circumferential groove 47 is cut into the inner surface of the inner bore of the main axle shaft 42. The locking portion works exactly the same as in the second embodiment, but the dimensions of the components are smaller. The main and secondary axle shafts 40 and 42 are inserted from opposite sides of the skate frame, pass through the frame, bearings and bearing spacer, and lock together forming the axle.

In the illustrative embodiment, the main axle shaft 40 has an outer diameter of about 0.3125 inches and is adapted for insertion through apertures 2A and 2B formed in the frame rail 2A and 2B. Rounded cap portion 44 is about 0.1875 inches at its thickest point. A recess 48, 0.0625 inches deep and 0.089 inches long is machined into one half of the cap in order to allow for an access point for the release pin 45.

A hole 49 having a 0.0625 inch diameter is drilled through the release pin shaft at about 0.093 inches from one end thereof, as shown in FIG. 9. The function of hole 49 is to allow a tool or pin to be used to pull the release pin 45 out of the axle shaft during axle release operations. When the secondary axle shaft 42 is retained within the main axle shaft, during the axle locked configuration, the hole in the release pin is recessed within the end of the axle shaft and thus cannot be inadvertently pulled out during roller skating activity.

As shown in FIG. 9, a small return spring 16 is installed over the central body portion of the release pin shaft and restrained by an enlarged annular-shaped flange 50, which is designed to engage balls 12 in the system's locked configuration. The function of the return spring is to hold the release pin in the locked position within the axle shaft during the vibration encountered while skating. Within this arrangement, the return spring is then trapped between the annular 50 and the inner flange 51 of the machined groove bore 52 formed in the axle shaft, while the retaining pin 24 is inserted into the slot 53 formed in the end of the release pin, as shown in FIG. 9. As such, the release pin 45 is retained within the bore of the secondary axle shaft and is permitted to slide therewithin a distance equal to the length of slot 53 formed in the end of the release pin. As shown in FIG. 9, a curved spring steel washer 27 is positioned over the secondary axle shaft 42 which tightens the axle system in the locked configuration. Also, a nylon plastic cover can be snapped over the cap end of the second axle shaft.

Assembly and Disassembly of the Quick-Release Axle System of the Third Illustrative Embodiment of the Present Invention Each bearing 7A, 7B is installed into the wheel from opposite sides. Then, the main axle shaft is inserted into the bore of the wheel and thereafter the secondary axle shaft is slid into the bore within the main axle shaft. When the release pin 45 is slid into the bore of the second axle shaft, the two steel locking balls are automatically forced into placed into the circumferential groove 54 formed within the control portion of the bore 52 within the main axle shaft. In this configuration, the end of the release pin will remain recessed within the bore of the primary axle shaft, while the primary axle shaft and second axle shaft are securely locked together and the release pin prevented from being inadvertently pulled out of its locked configuration. In this locked configuration, shown in FIG. 9, the release pin 45 renders it impossible for the axle-locking balls 12 to move downward, or out of their corresponding detents, and thus provides an extremely strong and efficient locking mechanism.

When the release pin 45 is pulled outwardly by an amount limited by the length of slot 53, (i.e. against the outwardly directed biasing forces produced by the return spring), the ball bearings 12 are permitted to fall within the narrow circumferential groove 54. In this unlocked configuration, the secondary axle shaft 42 is released from the primary axle shaft 40 and can be withdrawn therefrom, as well as the wheel assembly and the skate frame. When the release pin on a particular wheel has been "released" or arranged into its unlocked configuration, then the secondary axle shaft can be withdrawn from the primary axle shaft and the wheel assembly easily removed from the frame of the in-line skate.

Pulling the spring-biased release pin 45 out from the main axle shaft can be carried out using a small tool, (e.g. a paper clip or accessory device) that slides through the hole 48 formed in the end of the release pin.

Figure 10A:
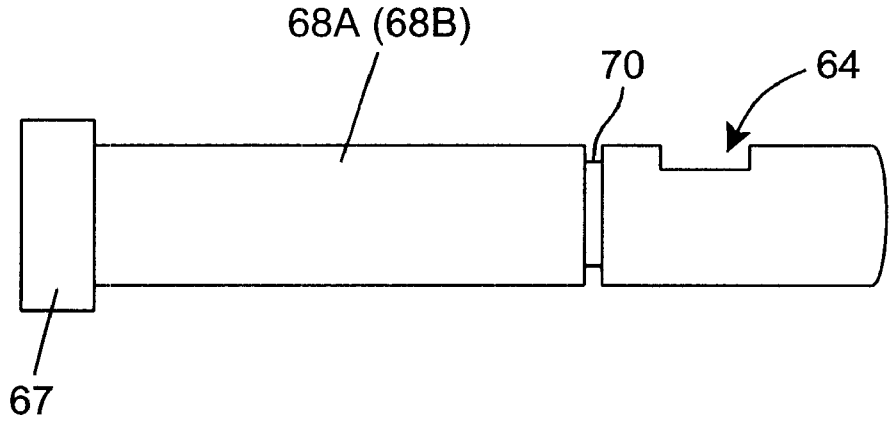
FIG. 10A is an elevated side view of the release pin as used in conjunction with the quick-release axle system of the second embodiment of FIG. 10, which utilizes the "push" method for axle release.
Figure 10:
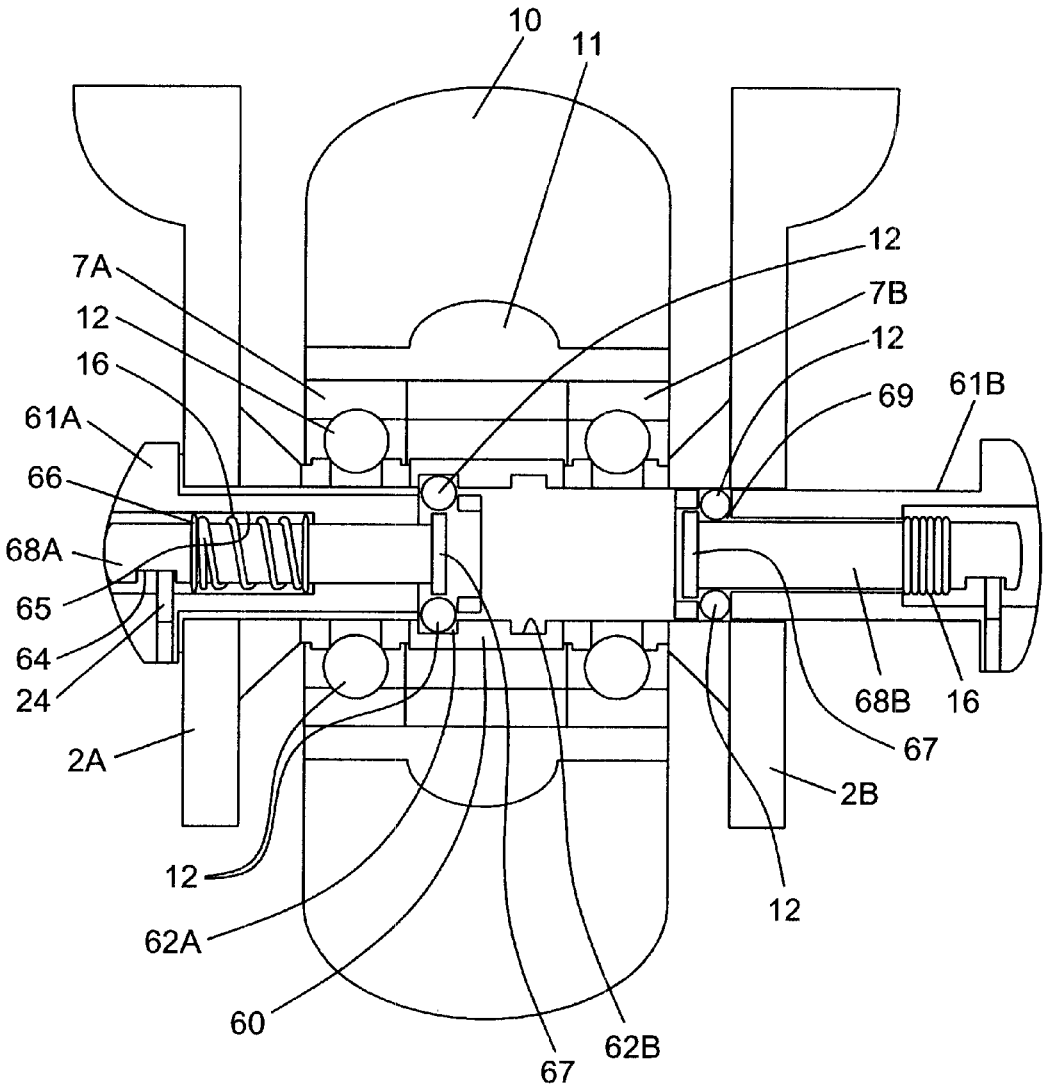
FIG. 10 is an elevated, cross-sectional schematic diagram of the fourth illustrative embodiment of the quick-release axle system of the present invention, showing a pair of axle portions.

In-Line Skate Embodying the Quick-Release Axle System of the Fourth Illustrative Embodiment of the Present Invention FIGS. 10 and 10A, a fourth illustrative embodiment of the quick release axle system is shown. In this embodiment, wherein the release pins are released by a "pushing" operation rather than by a pulling operation. As in the case of the second illustrative embodiment, each bearing 7A, 7B is installed into the wheel 10 from opposite sides and separated by bearing spacer 60. As the axle shafts 61A (61B) are inserted into the bore of the bearing spacer, the locking balls 12 held within the shaft by crimpings, automatically fall into place within corresponding grooves 62A (62B). Then as the release pin 68A (68B) is slid within the inner bore of the axle shaft and the retaining pin 24 inserted within the slot 64 formed therein, the return spring 16, retained between circumferential flange 65 and c-clip 66 (in circumferential groove 70) will automatically force the release pin outwards (away from the center of the bearing spacer) so that circumferential flange 67 is disposed directly beneath and contacts the surface of the axle-locking balls 12, forcing them to remain locked within the circumferential groove 62(A), 62(B) formed in the bearing spacer. In this configuration, the end of the release pin will remain recessed within the bore of the axle shaft while the axle shaft and bearing spacer are securely locked together and the release pin prevented from being inadvertently pulled out of its locked configuration. In this locked configuration, shown in the right side of the figure of FIG. 10, the release pin 68A 68(B) renders it impossible for the axle-locking balls 12 to move downward, or out of their corresponding grooves 62A 62(B), and thus provides an extremely strong and efficient locking mechanism.

When the release pin 9A (9B) is pushed inwardly by an amount limited by the length of slot 64, (i.e., against the outwardly directed biasing forces produced by return spring), the axle-locking balls 12 are permitted to fall within the narrow circumferential recess 69 formed between the outer surface and end portions of the release pin, as shown in the right side of the figure of FIG. 10. In this unlocked configuration, the axle shaft is released from the bearing spacer and can be withdrawn from the bearing spacer 30, wheel assembly and skate frame. When both release pins on a particular wheel have been "released" or arranged into their unlocked configuration, then the associated axle shafts can be withdrawn from the bearing spacer 30 and the wheel assembly easily removed from the frame of the in-line skate.

Pushing the spring-biased release pin 68A (68B) into its corresponding axle shaft can be carried out using a small tool (e.g., a screw driver or accessory device) that is slid into the open end of the bore in the axle shaft, and pushed against release pin (against the force of the return spring) so that the axle-locking balls 12 retaining the axle shaft within the bearing spacer 60 can be allowed to fall out of their corresponding holes, as described above.

Figure 11:
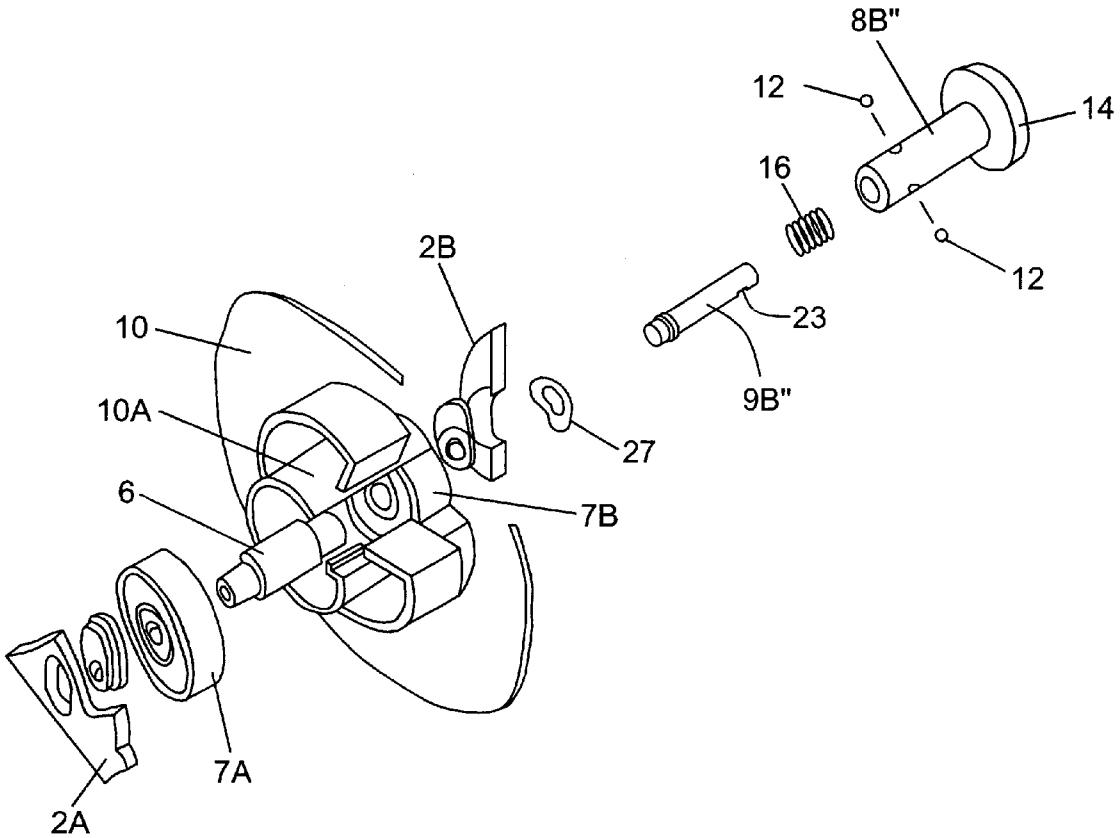
FIG. 11 is a exploded diagram of the fifth illustrative embodiment of the quick-release axle system of the present invention.
Figure 11A:
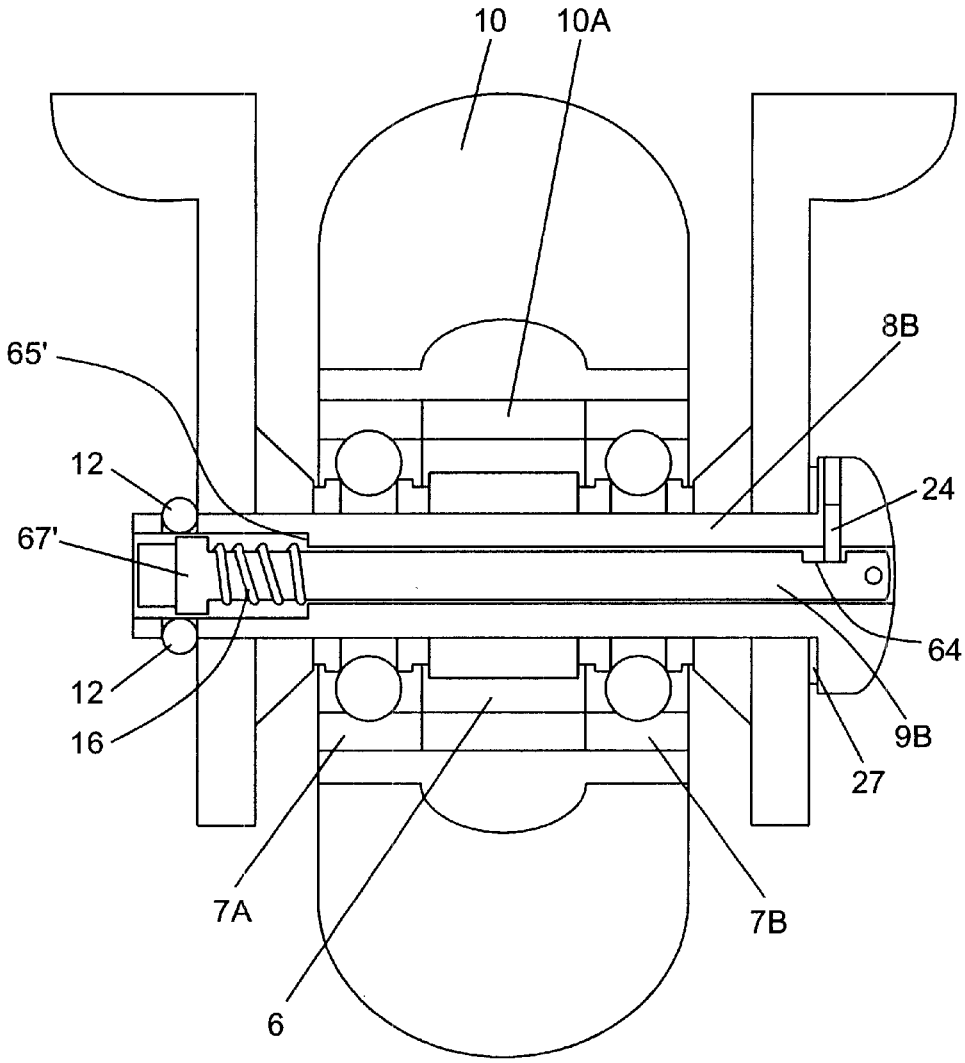
FIG. 11A is an elevated cross-sectional schematic diagram of the fifth illustrative embodiment of the quick-release axle system of FIG. 11, which utilizes the "push" method for axle release.

In-Line Skate Embodying the Quick-Release Axle System of the Fifth Illustrative Embodiment of the Present Invention FIGS. 11 and 11A, a fifth illustrative embodiment of the quick release axle system is shown. The fifth embodiment of the present invention is constructed in the same manner as the second embodiment except that only a single axle shaft 8B" is used instead of two separate axle shafts to support each wheel. In this configuration, the axle shaft 8B" does not interlock with the bearing spacer 6. Instead, the axle shaft 8B" is made long enough to pass through the skate frame 2B from one side, through the frame spacer, wheel and bearing assemblies 7A, 7B and the axle aperture in the frame portion on the opposite side. The interlocking balls 12 then use the outer surface of the other side of the skate frame 2A itself to lock the axle shaft in place when the release pin 9B" is allowed to slide into position, beneath the locking balls, within the main axle bore 70 formed therein.

As in the case of the second illustrative embodiment, each bearing 7A, 7B is installed into the wheel 10 from opposite sides and separated by bearing spacer 6. As the axle shaft 8B" is inserted through the bore of the bearing spacer, and bearings 7A, 7B and frame rails 2A, 2B as shown in FIG. 11A, the locking balls 12 held within the shaft by crimpings, automatically fall into place outside the outer surface of skate frame 2A, creating a choking mechanism. Then as the release pin 9B" is slid within the inner bore of the axle shaft (or the side of frame rail 2A) and the retaining pin 24 inserted within ten slot 64 formed therein, the return spring 16, retained between circumferential flanges 65' and 67' will automatically force the release pin outwards (away from the center of the bearing spacer) so that circumferential flange 67' is disposed directly beneath and contacts the surface of the axle-locking balls 12, forcing them to remain locked outside frame rail 2A. In this configuration, the end of the release pin will remain recessed within the bore of the axle shaft, while the axle shaft is securely locked between the frame rails 2A and 2B while the release pin 9B" is prevented from being inadvertently pulled out of its locked configuration. In this locked configuration, shown in the right side of the figure of FIG. 11A, the release pin 9B" renders it impossible for the axle-locking balls 12 to move downward, or away from the outer surface of frame unit 2A, and thus provides an extremely strong and efficient locking mechanism.

When the release pin 9B" is pulled automatically outwardly by an amount limited by the length of slot 64, (i.e., against the outwardly directed biasing forces produced by return spring), the axle-locking balls 12 are permitted to fall within the central bore of the axle shaft. In this unlocked configuration, the axle shaft is released from the frame rails 2A and can be withdrawn from the bearing spacer 6, wheel assembly and skate frame. When the release pin on a particular wheel has been "released" or arranged into its unlocked configuration, then the associated axle shaft can be withdrawn from the bearing spacer and the wheel assembly easily removed from the frame of the in-line skate.

In the alternative embodiment of the axle system shown in FIGS. 11 and 11A, a cap can be used to engage with locking balls 12, outside of the rail frame 2A. In such an embodiment, the cap will have an inner bore with a diameter which is slightly larger than the diameter of the axle shaft 8B". A circumferential groove is then machined at a predetermined distance from one end of the cap within the inner bore. The cap is then pressed onto the protruding portion of the axle shaft 8B" from the opposite side of the frame 2A. The locking balls 12 then interlock within the circumferential groove in the cap when the release pin is allowed to slide into position within the bore formed through the axle shaft 8B".

As in the previous examples, the axles may be designed so that releasing the axle from the skate is accomplished by pulling the release pin outward slightly, or they may be designed so that the release procedure involves pushing the release pin inward slightly.

While the present invention has been exemplified by the illustrative embodiment thereof described above, it is understood that such embodiments can be readily modified without departing from the shape and spirit of the present invention set forth by the appended claims to invention.

What is claimed is:

1. An axle system for use in an in-line skate having a plurality of wheels rotatably supported by a pair of wheel bearings disposed between a pair of spaced apart frame rails, said axle system having a locked configuration and an unlocked configuration and comprising:

a pair of axle shafts for passage through said frame rails and one of said wheels for rotatably supporting said wheel between said frame rails along a rotational axis;

at least one of said axle shafts having a cap portion with an access opening through which an axial bore is formed and extends along at least a portion of said axle shaft;

a release pin for insertion through said access opening and into said axial bore and automatically engaging with and locking said axle shafts relative to each other when said axle shafts and said release pin are arranged in said locked configuration thereby preventing said axle shafts from disengaging from said wheel during skating, and for automatically releasing said axle shafts from said wheel when said axle shafts and said release pin are arranged in said unlocked configuration;

a lateral bore formed through said cap portion of one of said axle shafts;

a slot formed in the end of said release pin; and a retaining pin passing through said lateral bore and releasably engaging within said slot formed in said release pin during said locked configuration to releasably and securely retain said release pin within said axial bore formed through said axle shaft until said retaining pin is manually disengaged from said slot during said unlocked configuration.

2. The axle system of claim 1, wherein said release pin is spring biased within said axial bore to a predetermined locking position which automatically locks said axle shafts relative to each other when said axle shafts and release pin are arranged in said locking configuration.

3. The axle system of claim 2, which further comprises a plurality of balls arranged within at least one said axle shaft for engagement with said release pin and said axle shaft so as to automatically interlock said axle shafts when said axle shafts and said release pin are arranged in said locked configuration.

4. An axle system for use in an in-line skate having a plurality of wheels rotatably supported by a pair of wheel bearings disposed between a pair of spaced apart frame rails, said axle system having a locked configuration and an unlocked configuration and comprising:

a pair of axle shafts for passage through said frame rails and one of said wheel for rotatably supporting said wheel between said frame rails along a rotational axis, and at least one of said pair of axle shafts having an axial bore formed therethrough along said rotational axis;

a release pin for insertion into said axial bore and releasably engaging with and locking said axles shafts relative to each other when arranged in said locked configuration to prevent said axle shafts from disengaging from said wheel during skating, and for releasing said axle shafts from said wheel when arranged in said unlocked configuration;

a lateral bore formed through said cap portion of one of said axle shafts;

a slot formed in the end of said release pin; and a retaining pin passing through said lateral bore and releasably engaging within said slot formed in said release pin during said locked configuration to releasably and securely retain said release pin within said axial bore formed through said axle shaft until said retaining pin in manually disengaged from said slot during said unlocked configuration;

wherein said release pin is spring biased within said bore to a predetermined locking position which locks said axle shafts relative to each other when arranged in said locked configuration; and wherein at least one said axle shaft has a cap portion with a hole formed therethrough in communication with said axial bore, and said release pin has a notch formed in said release pin so that when a retaining pin is inserted through said hole, said retaining pin is engaged within said notch and delimits the amount that said release pin is permitted to slide within said axial bore.

5. An axle system for use in an in-line skate having a plurality of wheels rotatably supported by a pair of wheel bearings disposed between a pair of spaced apart frame rails, said axle system having a locked configuration and an unlocked configuration and comprising:

an axle shaft for passage through said frame rails and one of said wheels for rotatably supporting said wheel between said frame rails along a rotational axis, and said axle shaft having a cap portion with an access opening through which an axial bore is formed and which extends along at least a portion of the rotational axis of said axle shaft;

a release pin for insertion through said access opening in said cap portion and into said axial bore and automatically engaging with locking said axle shaft relative to said frame rails when said axle shaft and release pin are arranged in said locked configuration thereby preventing said axle shaft from disengaging from said wheel during skating, and for automatically releasing said axle shaft from said wheel when said axle shaft and said release pin are arranged in said unlocked configuration;

a lateral bore formed through said cap portion of one of said axle shafts;

a slot formed in the end of said release pin; and a retaining pin passing through said lateral bore and releasably engaging within said slot formed in said release pin during said locked configuration to releasably and securely retain said release pin within said axial bore formed through said axle shaft until said retaining pin is manually disengaged from said slot during said unlocked configuration.

6. An in-line skate having a quick-release type axle system, comprising:

a pair of spaced apart frame rails;

a plurality of wheels, each said wheel being rotatable about by an axle system rotatably supported about a pair of wheel bearings disposed between said pair of spaced apart frame rails; and said axle system having a locked configuration and an unlocked configuration and including an axle shaft for passage through said frame rails and one of said wheels for rotatably supporting said wheel between said frame rails along a rotational axis, and said axle shaft having a cap portion with an access opening through which an axial bore is formed and which extends along at least a portion of the rotational axis of said axle shaft, a release pin for insertion through said access opening and into said axial bore and automatically engaging with and locking said axle shaft relative to said frame rails when said axle shaft and release pin are arranged in said locked configuration thereby preventing said axle shaft from disengaging from said wheel during skating, and for automatically releasing said axle shaft from said wheel when said axle shaft and said release pin are arranged in said unlocked configuration;

a lateral bore formed through said cap portion of said axle shaft;

a slot formed in the end of said release pin; and a retaining pin passing through said lateral bore and releasably engaging within said slot formed in said release pin during said locked configuration to releasably and securely retain said release pin within said axial bore formed through said axle shaft until said retaining pin is manually disengaged from said slot during said unlocked configuration.

7. An axle system for use in an in-line skate having a plurality of wheels rotatably supported by a pair of wheel bearings disposed between a pair of spaced apart frame rails, said axle system having a locked configuration and an unlocked configuration and comprising:

a pair of axle shafts for passage through said frame rails and one of said wheels for rotatably supporting said wheel between said frame rails along a rotational axis;

at least one of said axle shafts having a cap portion with an access opening through which an axial bore is formed and extends along at least a portion of said axle shaft;

a release pin for insertion through said access opening and into said axial bore and automatically locking said axle shafts relative to each other when said axle shafts and said release pin are arranged in said locked configuration thereby preventing said axle shafts from disengaging from said wheel during skating, and for automatically releasing said axle shafts from said wheel when said axle shafts and said release pin are arranged in said unlocked configuration;

a lateral bore formed through said cap portion of one of said axle shafts;

a slot formed in the end of said release pin; and a retaining pin passing through said lateral bore and releasably engaging within said slot formed in said release pin during said locked configuration to releasably and securely retain said release pin within said axial bore formed through said axle shaft until said retaining pin is manually disengaged from said slot during said unlocked configuration.

* * * * *